US008179255B1

(12) United States Patent
Lamore et al.

(10) Patent No.: US 8,179,255 B1
(45) Date of Patent: May 15, 2012

(54) PERSONAL SECURITY PURSE

(76) Inventors: Muraguet Lamore, Uniondale, NY (US); Myrtha Lamore, Uniondale, NY (US)

( * ) Notice: Subject to any disclaimer, the term of this patent is extended or adjusted under 35 U.S.C. 154(b) by 365 days.

(21) Appl. No.: 12/561,904

(22) Filed: Sep. 17, 2009

(51) Int. Cl.
*G08B 21/00* (2006.01)

(52) U.S. Cl. ..... 340/540; 340/541; 340/568.7; 340/545.6; 340/539.13; 340/539.19; 340/573.1; 340/573.4

(58) Field of Classification Search ..... 340/540, 340/541, 568.1, 568.7, 545.6, 539.13, 539.19, 340/573.1
See application file for complete search history.

(56) References Cited

U.S. PATENT DOCUMENTS

| | | | | |
|---|---|---|---|---|
| 3,696,380 | A | 10/1972 | Murphy | |
| 3,893,096 | A | 7/1975 | Tucci et al. | |
| 4,394,644 | A | 7/1983 | Di Leo et al. | |
| D278,318 | S | 4/1985 | Levin et al. | |
| 4,755,802 | A | 7/1988 | Urbanczyk | |
| D343,060 | S | 1/1994 | Diaz et al. | |
| 5,955,948 | A | 9/1999 | Howell | |
| 5,963,131 | A * | 10/1999 | D'Angelo et al. | 340/568.1 |
| 6,686,840 | B1 | 2/2004 | Hammond et al. | |
| 7,064,667 | B2 | 6/2006 | Sosna | |
| 7,295,102 | B2 * | 11/2007 | Yamazaki et al. | 340/426.16 |
| 7,321,783 | B2 * | 1/2008 | Kim | 455/556.1 |
| 7,400,249 | B2 * | 7/2008 | Monroe | 340/572.1 |
| 2008/0102785 | A1 * | 5/2008 | Childress et al. | 455/404.1 |

* cited by examiner

*Primary Examiner* — Tai T Nguyen
(74) *Attorney, Agent, or Firm* — Kyle Fletcher

(57) ABSTRACT

The personal security purse comprises a handbag, suitcase, backpack, purse, or luggage that has a security device integrated into the design. The security device comprises a panic button located on the purse, a video recording means, an audio recording means, a speaker. The security device can be remotely operated via a remote control. The security device may also include a plurality of alarm sensors as well as a GPS unit for location based services.

16 Claims, 4 Drawing Sheets

PERSONAL SECURITY PURSE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of purses or handbags, more specifically, a purse or handbag that provides enhanced levels of security and protection by including a voice recording means, a video recording means, a panic button, a GPS transmitter, and a plurality of alarm sensors.

B. Discussion of the Prior Art

As a preliminary note, it should be stated that there is an ample amount of prior art that deals with personal security devices and handbags. As will be discussed immediately below, no prior art discloses a handbag or purse that includes a purse, handbag, suitcase, backpack or luggage with all of the security devices integrated therein.

The Sosna Patent (U.S. Pat. No. 7,064,667) discloses a portable security alarm device for use with personal baggage including an alarm mechanism with speakers for emitting an audible alarm when activated, and a Panic button for immediately activating the alarm mechanism. However, the alarm device does not include an audio or video recording means, or a plurality of alarm sensors.

The Tucci et al. Patent (U.S. Pat. No. 3,893,096) discloses a handbag alarm system that is actuated by a pressure responsive switch. However, the handbag alarm system does not include a voice or video recording means or a panic button.

The Howell Patent (U.S. Pat. No. 5,955,948) discloses a purse alarm. However, the alarm can only sound an audible alarm, and not record voice or video via recording means.

The Diaz et al. Patent (U.S. Pat. No. Des. 343,060) illustrates an ornamental design for a purse with built-in alarm, indicator light, and mini-light. However, the purse does not illustrate audio or video recording means nor does it include GPS location based services or alarm sensors.

The Di Leo et al. Patent (U.S. Pat. No. 4,394,644) discloses a battery-powered alarm for a purse. However, the neither the alarm nor the purse include audio or video recording means.

The Urbanczyk Patent (U.S. Pat. No. 4,755,802) discloses a handbag, briefcase, or luggage alarm of the type that sounds an audible and/or visual alarm. However, the handbag does not include a panic button, voice recording means, audio recording means, a plurality of alarm sensors, GPS location based services, or a remote control.

The Hammond et al. Patent (U.S. Pat. No. 6,686,840) discloses a personal security alarm to be housed in a purse. However, the personal security alarm is only directed to an alarm, and not a purse or handbag having audio and video recording means as well as GPS location based services, or a remote control.

While the above-described devices fulfill their respective and particular objects and requirements, they do not describe a purse, handbag, suitcase, backpack or other type of luggage wherein said bag contains a video recording means, audio recording means, a remote control, a plurality of alarm sensors, and/or GPS location based speakers, and a speaker. In this regard, the personal security purse departs from the conventional concepts and designs of the prior art.

SUMMARY OF THE INVENTION

The personal security purse comprises a handbag, suitcase, backpack, purse, or luggage that has a security device integrated into the design. The security device comprises a panic button located on the purse, a video recording means, an audio recording means, a speaker. The security device can be remotely operated via a remote control. The security device may also include a plurality of alarm sensors as well as a GPS unit for location based services.

It is an object of the invention to provide a security device integrated into the design of a purse, handbag, backpack, suitcase, briefcase, or other type of luggage.

A further object of the invention is to provide a security device comprising a panic button that emits an audible alarm, and records voice and video via recording means.

It is a further object of the invention to provide a security device that can be remotely operated via a remote control.

A further object of the invention is to provide a motion sensor that once triggered will begin recording audio and video.

A further object of the invention is to provide a proximity switch that triggers both the audio and video recording means as well as sounding an alarm when the item of luggage is opened.

A further object of the invention is to provide a personal security purse that is easy to use, affordable, and effective.

These together with additional objects, features and advantages of the personal security purse will be readily apparent to those of ordinary skill in the art upon reading the following detailed description of presently preferred, but nonetheless illustrative, embodiments of the personal security purse when taken in conjunction with the accompanying drawings.

In this respect, before explaining the current embodiments of the personal security purse in detail, it is to be understood that the personal security purse is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the personal security purse. It is therefore important that the claims be regarded as including such equivalent construction insofar as they do not depart from the spirit and scope of the personal security purse. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
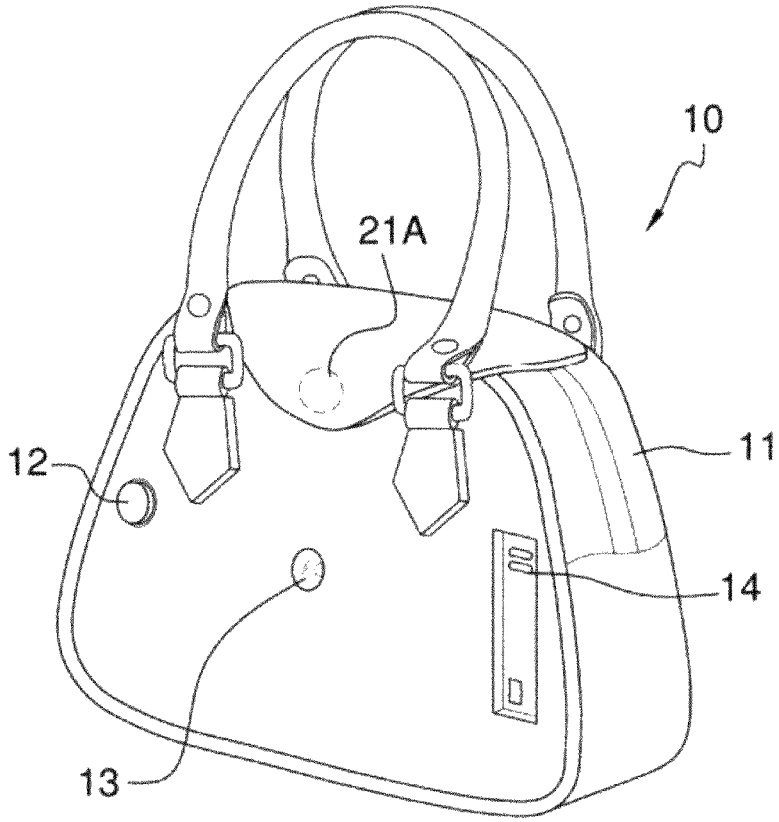
FIG. 1 illustrates a front, isometric view of the personal security purse wherein the audio recording means, video recording means, and panic button are visible from a front side of the personal security purse.
Figure 2:
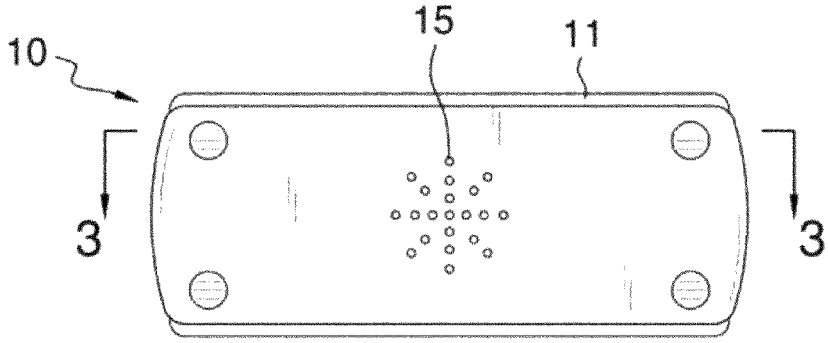
FIG. 2 illustrates a bottom view of the personal security purse, and detailing the location of the speaker that emits an audible alarm upon depression of the panic button from either the remote control or the panic button located on the purse.
Figure 3:
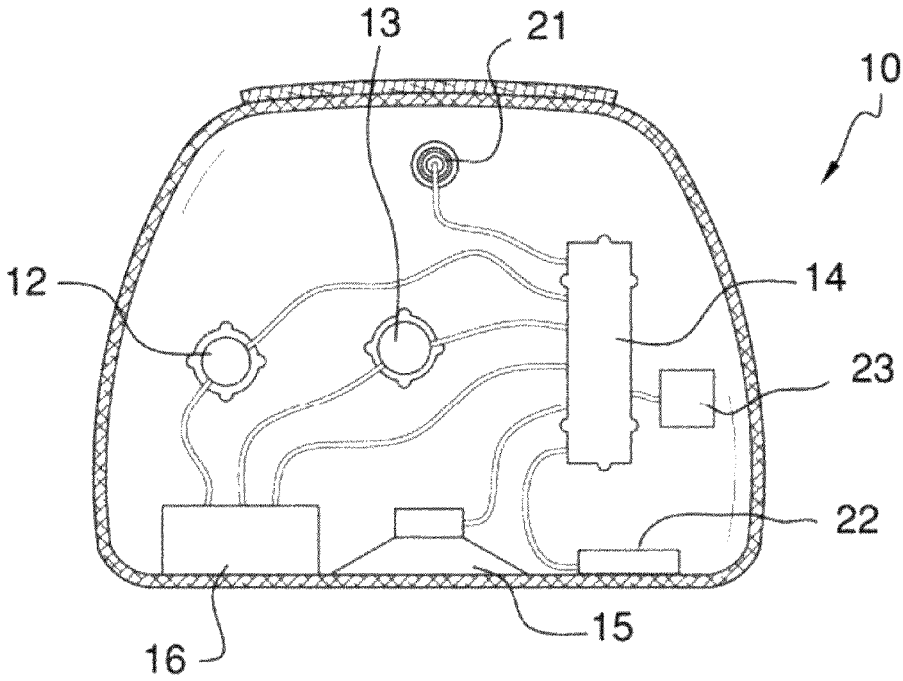
FIG. 3 illustrates a cross-sectional view of the personal security purse along line 3-3 in FIG. 2, and further detailing the speaker, the video recording means, the audio recording means, the panic button, a central processing unit (hereinafter CPU), a proximity switch, a motion sensor, and a global positioning system (hereinafter GPS)
Figure 4:
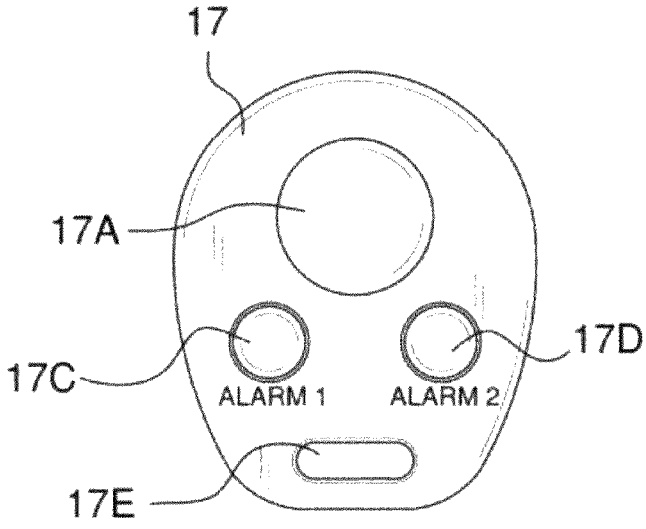
FIG. 4 illustrates a view of the remote control.
Figure 5:
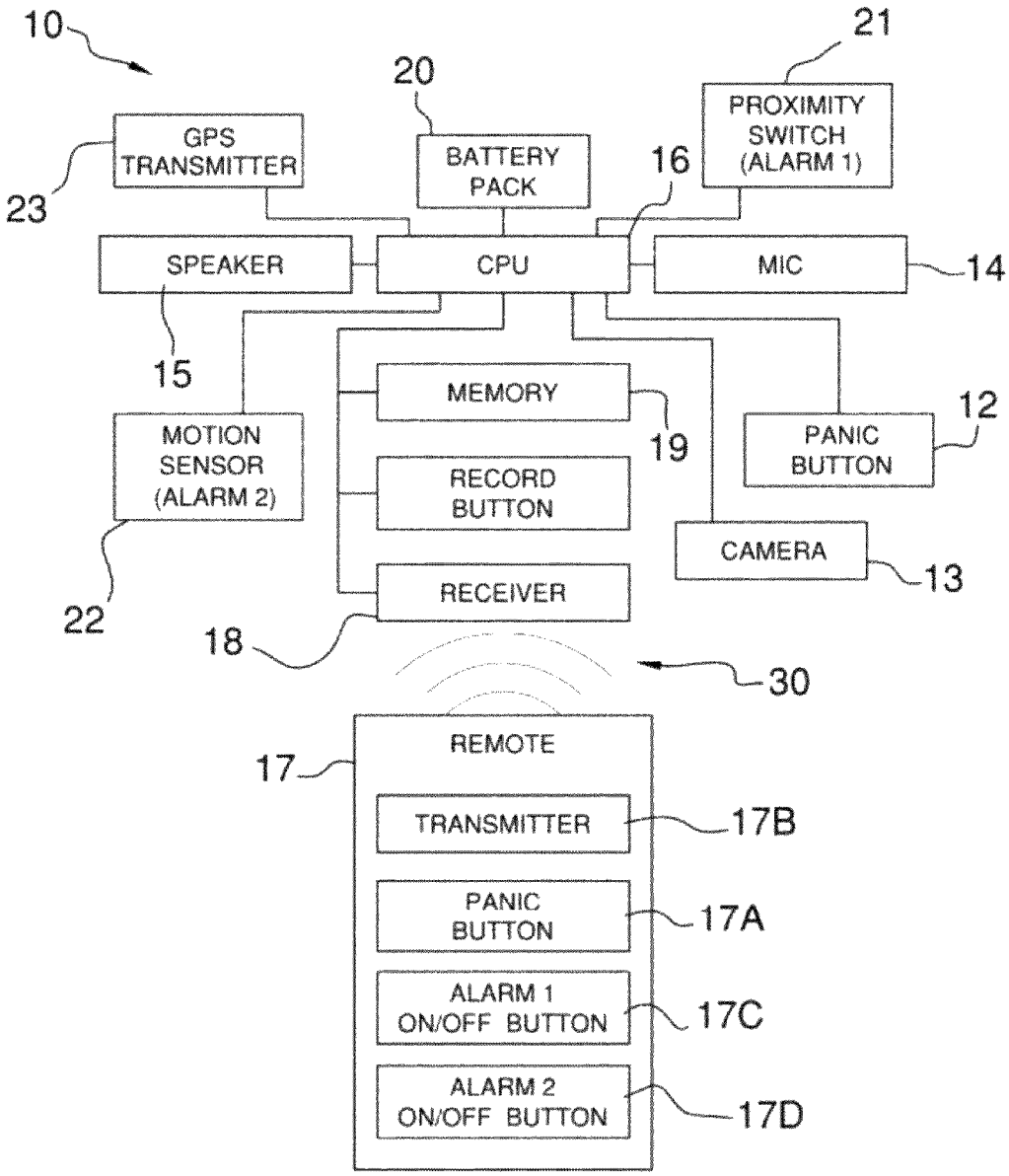
FIG. 5 illustrates a diagram of the various components of the personal security purse.

Detailed reference will now be made to the preferred embodiment of the present invention, examples of which are illustrated in FIGS. 1-5. A personal security purse 10 (hereinafter invention) includes a handbag 11 containing a panic button 12, a video recording means 13, an audio recording means 14, a speaker 15, a central processing unit 16 (hereinafter CPU), a remote control 17, a radio receiver 18, a memory drive 19, and a battery pack 20.

The remote control 17 has a panic button 17A that transmits a signal 30 via a transmitter 17B, which is received by the receiver 18. The remote control 17 enables remote operation of the panic button 12. The remote control 17 also has an alarm 1 on/off button 17C, and an alarm 2 on/off button 17D. The remote control 17 also includes a record button 17E that upon depression will cause the video recording means 13 and audio recording means 14 to operate, but will not sound an alarm via the speaker 15.

Upon depression of either the panic button 12 or panic button 17A, the speaker 15 emits an audible alarm, and the video recording means 13 records video while the audio recording means 14 records audio. The video recording means 13 is comprised of a camera that is able to record video footage or individual photos. The speaker 15 is integrated into a bottom of said handbag 11 in order to direct the audible alarm away from the bottom of the handbag 11, and also to distribute weight and balance the handbag 11. The handbag 11 includes footings 11A that slightly elevate the handbag 11 from the surrounding ground in order to enable the audible alarm to be effectively broadcasted. Absent the footings 11A, the audible alarm would be muffled by the bottom surface of the handbag 11.

The CPU 16 is connected to the speaker 15, and plays an audible alarm stored on the memory drive 19. Upon depression of either the panic button 12 or the panic button 17A, the video recording means 13 and audio recording means 14 are stored upon the memory drive 19 via the CPU 16. The CPU 16 is also connected to the receiver 18 as well as the panic button 12.

Figure 6:
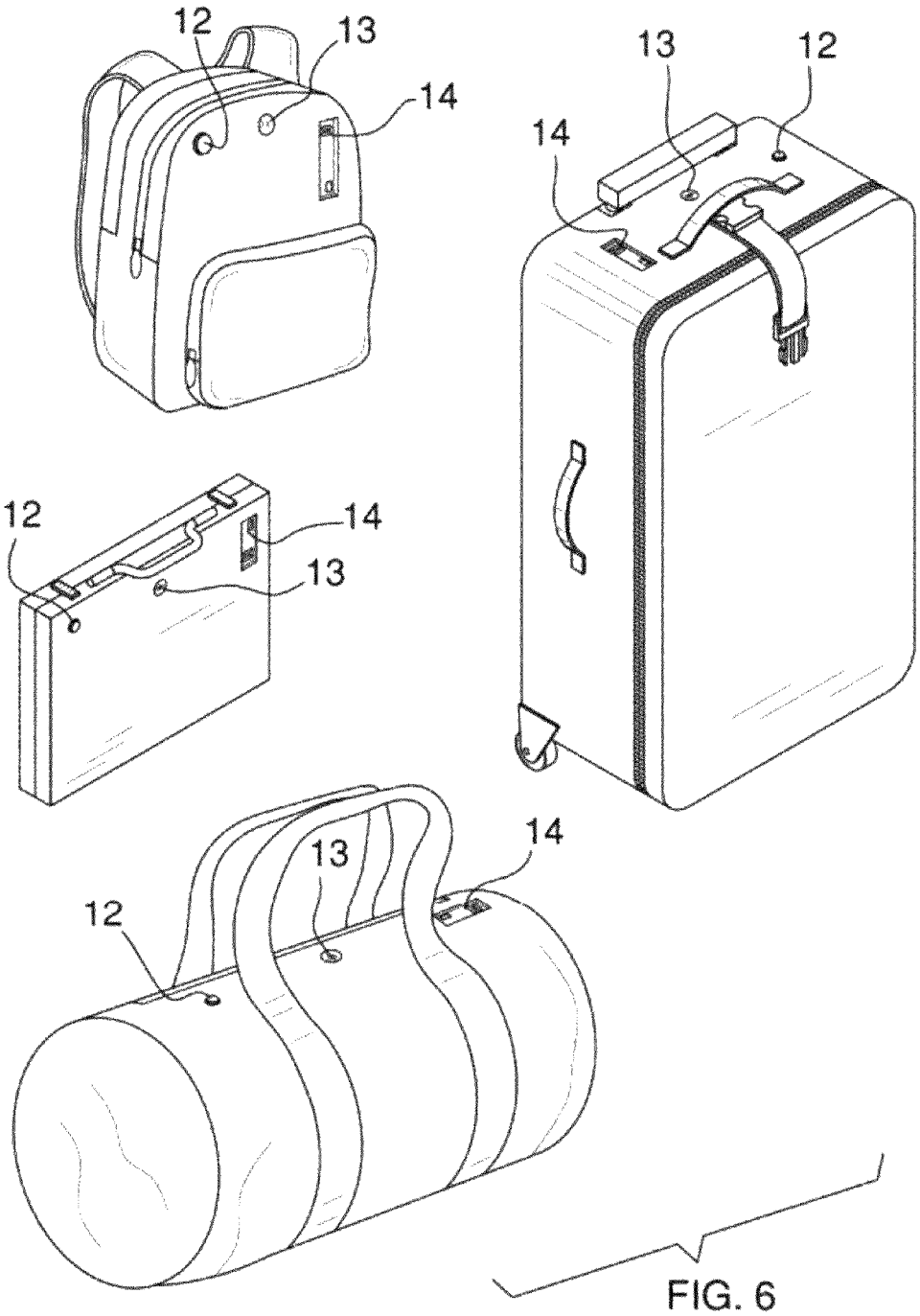
FIG. 6 illustrates other forms of luggage comprising a backpack, suitcase, briefcase, duffel bag, or other type of luggage wherein the security system described below is integrated into said forms of luggage.

The invention 10 may also include a proximity switch 21 that can be remotely operated via the remote control 17, and the alarm 1 on/off button 17C. The proximity switch 21 is designed to be set off when the handbag 11 is opened, and wherein will set off an alarm sequence wherein the speaker 15 emits an audible alarm, and the video recording means 13 records video while the audio recording means 14 records audio. It shall be noted that the proximity switch can be triggered via opening of a clasp 21A on the handbag 11 or other means integrated into a zipper or like closure structure typically associated with luggage of the type depicted in FIG. 6.

The invention 10 may also include a motion sensor 22 that can be remotely operated via the remote control 17, and the alarm 2 on/off button 17D. The motion sensor 22 is designed to be set off when the handbag 11 is moved, and wherein will set off an alarm sequence wherein the speaker 15 emits an audible alarm, and the video recording means 13 records video while the audio recording means 14 records audio.

The invention 10 may also include a global positioning system 23 (hereinafter GPS) that can be used to provide location-based services of the invention 10. The GPS unit 23 will be able to provide location of the invention 10 from a remote location. The GPS unit 23 can be triggered upon depression of either panic button 17A or 12, alarm sounding via the proximity switch 21 or motion sensor 22.

With respect to the above description, it is to be realized that the optimum dimensional relationship for the various components of the invention 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The invention claimed is:

1. A personal security handbag comprising:

a video recording means, audio recording means, a panic button, a central processing unit, a receiver that is connected to said central processing unit, and a speaker;

depression of said panic button results in an audible alarm being sounded via the speaker as well as audio and video being recorded by the audio recording means and the video recording means;

wherein a proximity switch is adjacent an access point of said handbag and of which when triggered causes an audible alarm being sounded via the speaker as well as audio and video being recorded by the audio recording means and the video recording mean, and of which can be controlled via an on/off button location on the remote control;

wherein a motion sensor is included within said handbag and of which when triggered by movement of said handbag causes an audible alarm being sounded via the speaker as well as audio and video being recorded by the audio recording means and the video recording mean, and of which is controlled via an on/off button location on the remote control.

2. The personal security handbag as described in claim 1 wherein said handbag is a purse, suitcase, briefcase, backpack, or other piece of luggage.

3. The personal security handbag as described in claim 1 wherein a remote control includes a transmitter that communicates with said receiver to remotely operate the panic button.

4. The personal security handbag as described in claim 1 wherein a global positioning system is included within said handbag and provides location based services for said handbag, and wherein said location based services are conducted upon depression of either panic button, or triggering of either the motion sensor or proximity switch.

5. The personal security handbag as described in claim 1 wherein the remote control includes a record button that upon depression will commence audio and video recording.

6. The personal security handbag as described in claim 1 wherein the central processing unit is powered via a plurality of batteries.

7. The personal security handbag as described in claim 1 wherein said speaker is integrated into a bottom portion of said handbag, and directs an audible alarm downwards with respect to said handbag.

8. The personal security handbag as described in claim 1 wherein said panic button adorns an exterior surface of said handbag.

9. The personal security handbag as described in claim 1 wherein said video recording means includes a camera that is contained within said handbag with an opening on an exterior surface, which enables viewing outside of said handbag.

10. The personal security handbag as described in claim 1 wherein said audio recording means further includes a microphone that is contained within said handbag with an opening on an exterior surface, which enables audible sound to be recorded by said microphone from outside of said handbag.

11. The personal security handbag as described in claim 1 wherein said central processing unit includes a memory drive that stores all data recorded by either the video recording means or audio recording means.

12. A personal security handbag comprising:

a video recording means, audio recording means, a panic button, a remote control, a central processing unit, a receiver, and a speaker;

depression of said panic button results in an audible alarm being sounded via the speaker as well as audio and video being recorded by the audio recording means and the video recording means;

wherein said receiver is connected to said central processing unit;

wherein said video recording means includes a camera that enables viewing outside of said handbag;

wherein said audio recording means further includes a microphone that is contained within said handbag with an opening on an exterior surface, which enables audible sound to be recorded by said microphone from outside of said handbag;

wherein said remote control includes a transmitter that communicates with said receiver to remotely operate the panic button;

wherein a proximity switch is adjacent an access point of said handbag and of which when triggered causes an audible alarm being sounded via the speaker as well as audio and video being recorded by the audio recording means and the video recording mean, and of which can be controlled via an on/off button location on the remote control;

wherein a motion sensor is included within said handbag and of which when triggered by movement of said handbag causes an audible alarm being sounded via the speaker as well as audio and video being recorded by the audio recording means and the video recording mean, and of which is controlled via an on/off button location on the remote control.

13. The personal security handbag as described in claim 12 wherein said handbag is a purse, suitcase, briefcase, backpack, or other piece of luggage.

14. The personal security handbag as described in claim 12 wherein said central processing unit includes a memory drive that stores all data recorded by either the video recording means or audio recording means.

15. The personal security handbag as described in claim 12 wherein a global positioning system is included within said handbag and provides location based services for said handbag, and wherein said location based services are conducted upon depression of either panic button, or triggering of either the motion sensor or proximity switch.

16. The personal security handbag as described in claim 12 wherein the remote control includes a record button that upon depression will commence audio and video recording.

* * * * *